US005623784A

United States Patent [19]

Kuersten et al.

[11] Patent Number: 5,623,784

[45] Date of Patent: Apr. 29, 1997

[54] WINDOW OPERATOR

[75] Inventors: William R. Kuersten, Pecatonia, Ill.; Duane T. Fier, Hudson, Minn.; Richard L. Bildahl, Rockford, Ill.; Kenneth D. Paulson, Albany, Oreg.

[73] Assignee: Andersen Corporation, Bayport, Minn.

[21] Appl. No.: 478,117

[22] Filed: Jun. 29, 1995

Related U.S. Application Data

[63] Continuation of Ser. No. 212,025, Mar. 11, 1994, abandoned.

[51] Int. Cl.[6] ..... E05F 11/24

[52] U.S. Cl. ..... 49/342; 49/345; 74/89.13; 74/89.14; 74/606 R

[58] Field of Search ..... 49/339, 340, 341, 49/342, 343, 346, 345; 74/89.13, 89.14, 606 R

[56] References Cited

U.S. PATENT DOCUMENTS

| | | | |
|---|---|---|---|
| D. 330,839 | 11/1992 | Barrington et al. | D8/315 |
| 1,297,479 | 3/1919 | Lane . | |
| 1,612,555 | 12/1926 | Walker . | |
| 1,769,131 | 7/1930 | Gray . | |
| 1,794,477 | 3/1931 | Sodergren . | |
| 1,883,619 | 10/1932 | Doering . | |
| 2,114,645 | 4/1938 | Van Benschoten | 268/117 |
| 2,250,524 | 7/1941 | Dietrichson | 105/307 |
| 2,304,960 | 12/1942 | Schane | 268/74 |
| 2,321,800 | 6/1943 | Cordrey et al. | 263/119 |
| 2,390,394 | 12/1945 | Smith | 20/53 |
| 2,610,054 | 9/1952 | Reynaud | 268/119 |
| 2,636,727 | 4/1953 | Toth | 268/21 |
| 2,709,582 | 5/1955 | Chapman | 268/23 |
| 2,720,292 | 10/1955 | Roberts | 189/67 |
| 2,795,413 | 6/1957 | Rodaway | 268/105 |
| 2,817,978 | 12/1957 | Kennedy, Sr. et al. | 74/424.8 |
| 2,926,905 | 3/1960 | Ahlgren | 74/89.13 |
| 3,103,351 | 9/1963 | Ahlgren | 268/117 |
| 3,117,351 | 1/1964 | Ahlgren | 20/42 |
| 3,722,142 | 3/1973 | Anderberg et al. | 49/248 |
| 4,253,276 | 3/1981 | Peterson et al. | 49/249 |
| 4,301,622 | 11/1981 | Dunsmoor | 49/342 |
| 4,305,228 | 12/1981 | Nelson | 49/252 |
| 4,616,443 | 10/1986 | Araki et al. | 49/252 |
| 4,833,754 | 5/1989 | Yang | 16/339 |
| 4,840,075 | 6/1989 | Tucker | 74/89.14 |
| 4,980,947 | 1/1991 | McQuigge | 16/253 |
| 5,152,103 | 10/1992 | Tucker et al. | 49/279 |
| 5,168,770 | 12/1992 | Ellis | 74/545 |
| 5,233,879 | 8/1993 | Watanuki et al. | 74/89.14 X |

FOREIGN PATENT DOCUMENTS

| | | |
|---|---|---|
| 2623843 | 6/1982 | France . |
| 831512 | 6/1952 | Germany . |
| 2153005 | 8/1985 | United Kingdom . |

*Primary Examiner*—Philip C. Kannan

*Attorney, Agent, or Firm*—Merchant, Gould, Smith, Edell, Welter & Schmidt, P.A.

[57] ABSTRACT

A window operator mechanism 10 includes a worm gear 22 which is generally parallel to the window when closed. A drive gear 24 is generally transverse and is at 45° angle to the horizon. The operator 10 includes a housing 11 which is designed for drop-in assembly and includes 3 open gear receiving receptacles 15, 16 and 17.

15 Claims, 6 Drawing Sheets

FIG.8
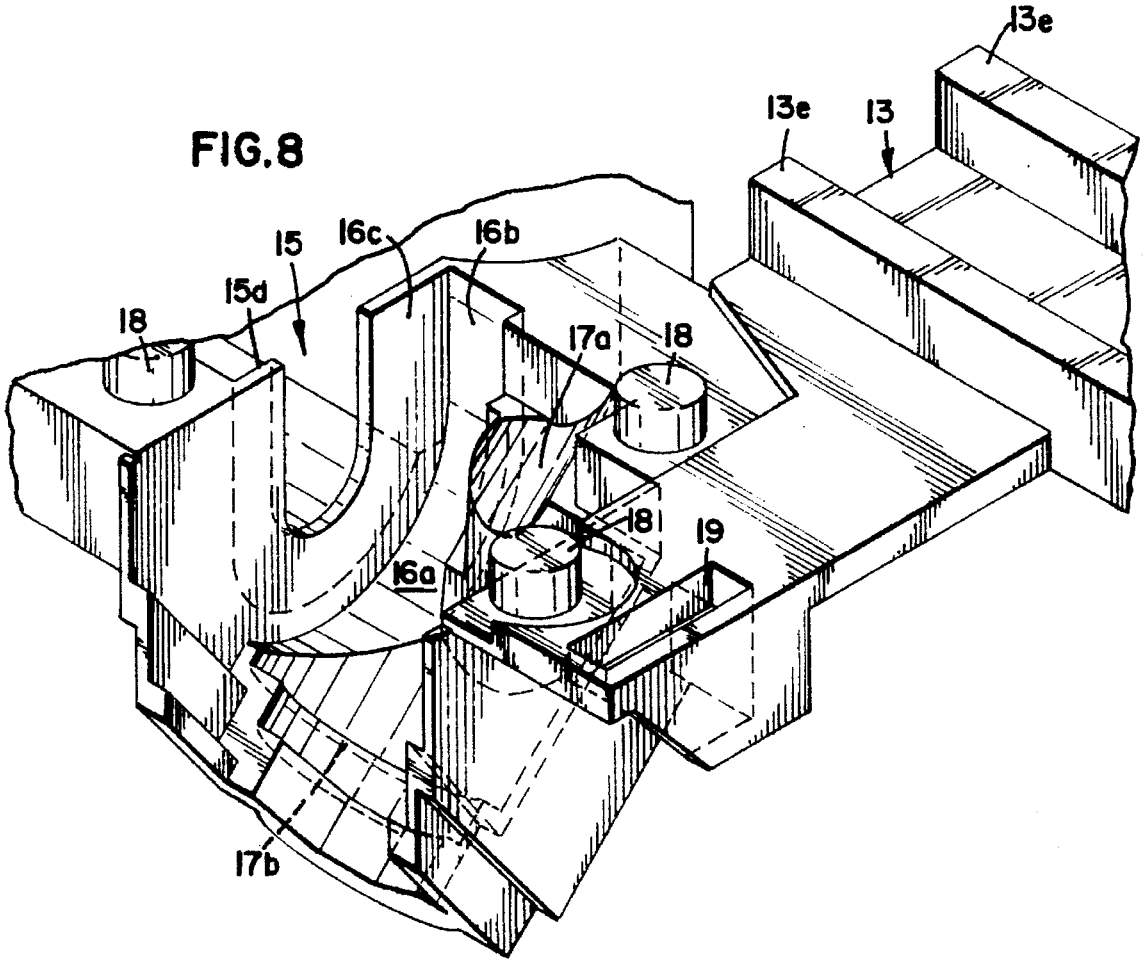
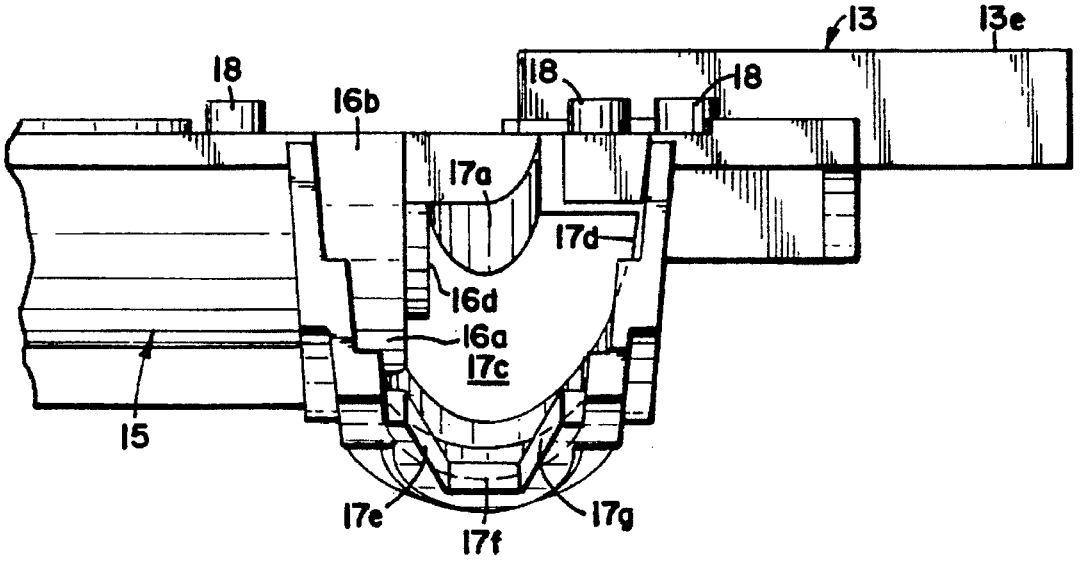
FIG.9

WINDOW OPERATOR

This is a continuation of application Ser. No. 08/212.025, filed Mar. 11, 1994, now abandoned.

BACKGROUND OF THE INVENTION

1. Field of the Invention

This invention relates generally to an operator for opening and closing a window and more particularly to an operator designed to prevent backdrive, rotate 180° for left and right hand applications and also to an operator designed for drop-in assembly, as well as a method of assembling the operator.

2. Description of the Prior Art

Operator mechanisms for opening windows are of course well known in the art. However, one of the problems associated with most operators is the fact that when the window is in an open position, the window is subject to back and forth motions caused by wind or other external forces. This back and forth motion of the window is transferred to the operator and the operator will tend to move, thereby causing the window to open even further. Further, window operators have a direct drive between the handle, which operates the operator, and the worm gear which in turn drives the operator arm. That is, the gears are generally in axial alignment.

When window operators are operated by persons without great physical strength, it is sometimes difficult for the handle to be turned. The handle can not necessarily be made longer as a longer handle will interfere with other portions of the window as the handle is rotated. Most handles are at an angle of approximately 30° from the horizontal.

Operator mechanisms typically have a worm gear which is perpendicular to the face of the window when the window is closed. In doing so, the worm gear is positioned on one side of the gear on the arm. By doing so, this prevents rotation of the arm from going a full 180°. This necessitates the design of both a right and left handed operator depending upon whether the window opens to the right or to the left.

Still further, when assembling operators, the many various component of the operators have to be assembled by hand, while components are typically inserted inside of cavities or other complex arrangements. The assembly of these operators would be hard to automate.

The operator of the present invention is designed to address the problems associated with the prior art devices. The invention provides for an operator mechanism which substantially reduces the backdrive effect. Further, the invention utilizes a transverse design for the gearing so as to provide for a compact design which also allows for the operator to be unhanded. Further, the handle forms approximately 45° from the horizon, thereby allowing for greater leverage while the handle of the operator is turned. Still further, the present invention provides for a unique design which allows the assembly of the operator by insertion or "dropping in" of the components from a single direction, thereby allowing the assembly of the operator to be easily automated.

SUMMARY OF THE INVENTION

The present invention provides an operator mechanism for mounting to a window frame and a window sash for moving the sash between an open position and a closed position. The window frame has a centerline. The operator includes a housing having first, second and third gear receiving receptacles and an arm receiving hub operatively connected to the housing. A worm gear is positioned in the first gear receiving receptacle. The worm gear is generally parallel to the centerline of the window frame. A driven gear is positioned in the second gear receiving receptacle and is operatively connected to the worm gear. A drive gear is positioned in the third gear receiving receptacle. The drive gear is generally transverse to the center line of the window frame. A handle is operatively connected to the drive gear for rotational movement of the drive gear. An arm is operatively connected at its first end to the hub. The arm has gear teeth for operative engagement with the worm gear and the arm is operatively connected at its second end to the sash, wherein rotational movement of the handle, through the drive gear, driven gear, worm gear and gear teeth causes movement of the arm, thereby moving the sash between an open and closed position.

In another embodiment, the invention is an operator mechanism for mounting to a window frame and window sash for moving the sash between an open position and a closed position. The window frame has a centerline. The operator mechanism is designed for drop-in assembly. The operator includes a housing having first, second and third gear receiving receptacles. The receptacles each have an opening in a first direction. The housing has a hub operatively connected to the housing. The hub extends in the first direction. A worm gear has a shaft and is operatively connected to a driven gear having a bore, which is insertable over the shaft. The driven gear and the worm gear are placed in the first and second gear receiving receptacles by placing them in position through the openings in the first direction. An arm has first and second ends. The first end having an opening formed therein and gear teeth around its outer periphery. The arm is operatively connected to the housing by placing the opening over the hub from the first direction and the gear teeth engage the worm gear. A drive gear is placed in a third gear receiving receptacle by placing it into the third gear receiving receptacle opening in the first direction. A plate is operatively connected to the housing. The plate is positioned over the second end of the arm and gears. The plate is placed in position on the housing from the first direction and secured to the housing.

In another embodiment, the invention is a method of assembling an operator mechanism for mounting to a window frame and a window sash. The operator mechanism is for moving the sash between an open position and a closed position. The window frame has a centerline. The method includes positioning a housing having first, second and third gear receiving receptacles, each having an opening in a first direction and an arm receiving hub extending from the housing in a first direction, so that the openings in the hub are positioned upward. The worm gear is operatively connected to a driven gear and the worm gear and driven gear are placed down into the first and second receptacles. An arm, having first and second ends and having an opening formed therein and gear teeth around its outer periphery is placed down over the hub. A drive gear is placed down into the third receptacle. A plate is placed down over the housing and the plate is secured to the housing, whereby the operator mechanism is assembled.

BRIEF DESCRIPTION OF THE DRAWINGS

FIG. 8 is an enlarged exploded perspective of a portion of the cover used in the operator shown in FIG. 1;

FIG. 9 is a front plan view of the portion of the housing shown in FIG. 8;

DETAILED DESCRIPTION OF THE PREFERRED EMBODIMENT

Figure 11:
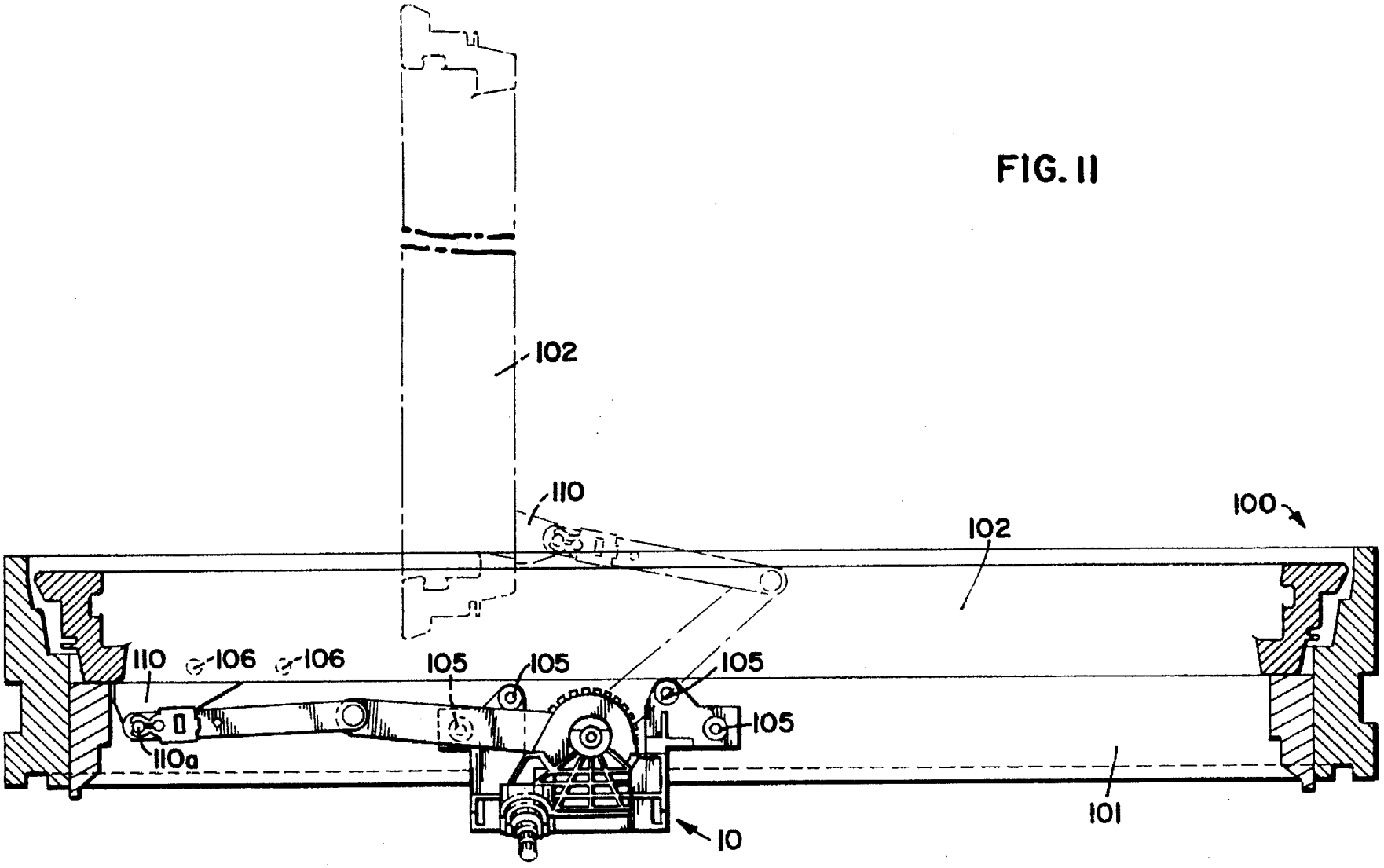
FIG. 11 is a top plan view of the operator of FIG. 1 mounted on a window, the window shown in cross-section.

Referring to the drawings, wherein like numerals represent like parts throughout the several views, there is generally disclosed at 10 an operator mechanism. The view in FIG. 11 shows the operator mechanism 10 mounted on a window.

Figure 1:
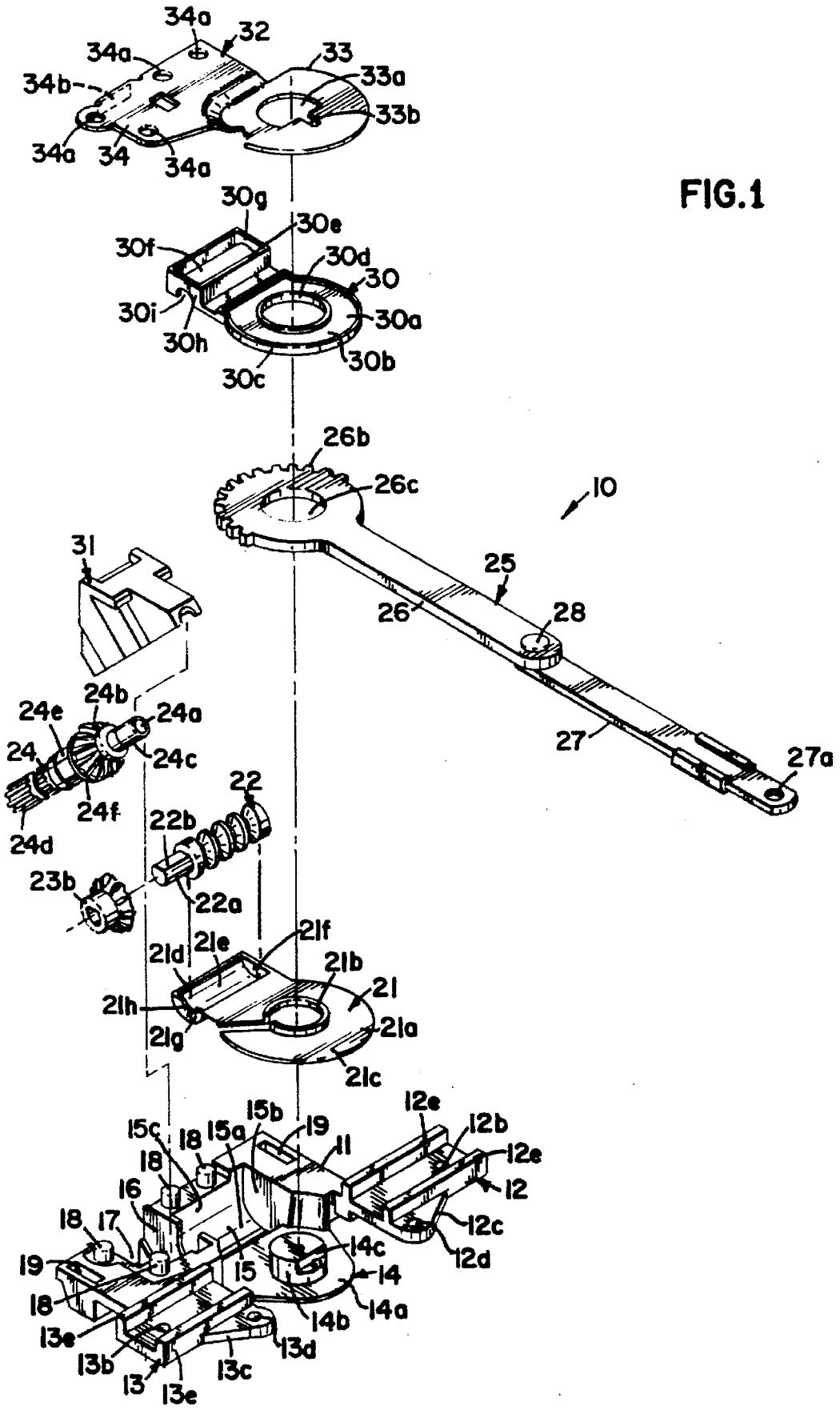
FIG. 1 is an exploded perspective view of the window operator showing the present invention.

The operator mechanism 10 is shown in FIG. 1 in an exploded perspective view as seen from the bottom of the operator mechanism 10. However, for clarity, the views in FIGS. 1 through 5 are shown inverted so as to best show the various components of the operator mechanism 10.

The operator mechanism 10 includes a housing or cover 11. The housing is preferably a one-piece housing, and may be made from any suitable material such zinc dichromate for strength and, if desired, plated and painted for increased durability. The housing 11 includes a first mounting flange 12 and a second mounting flange 13. The flanges have a generally flat top surface 12*a* and 13*a* in which mounting holes 12*b* and 13*b* are formed. On the surfaces 12*a* and 13*a*, the holes may be countersunk for ease of installation when screws are utilized to mount the operator 10 to the window frame. The flanges also have mounting ears 12*c* and 13*c* in which mounting holes 12*d* and 13*d* are formed. Similarly, these holes 12*d* and 13*d* may be countersunk. Each flange 12 and 13 has depending sides 12*e* and 13*e* to form a generally inverted U-shape. The housing 11 also includes an arm support member 14 side, as viewed in FIG. 1, having a generally planar surface 14*a* on which a mounting hub 14*b* is formed and extends generally downward, when the operator 10 is mounted, but is shown extending generally upward in FIG. 1. The mounting hub 14*b* is generally cylindrical but has a notch 14*c* formed therein on which a mounting pin 14*d* is formed. This pin 14*d* also extends generally downward when mounted.

The housing 11 has a first gear receiving receptacle 15. The receptacle 15 has a curved bottom surface 15*a* and sidewalls 15*b*, 15*c* and 15*d*. The receptacle 15 is open toward the bottom of the housing when mounted, or upwards as shown in FIG. 1.

A second gear receiving receptacle 16 is also formed in the housing 11 and is adjacent the first gear receiving receptacle 15. The gear receiving receptacle 16 includes a curved bottom surface 16*a* and sidewalls 16*b* and 16*c*. An indentation is formed in the sidewall 16*c*. The indentation has a sidewall 16*d* parallel to sidewall 16*c*. As will be discussed more fully hereafter, the indentation is for the collar of a driven gear. Again, the gear receiving receptacle 16 is open generally downward when mounted, or upward, as shown in FIG. 1.

Figure 7:
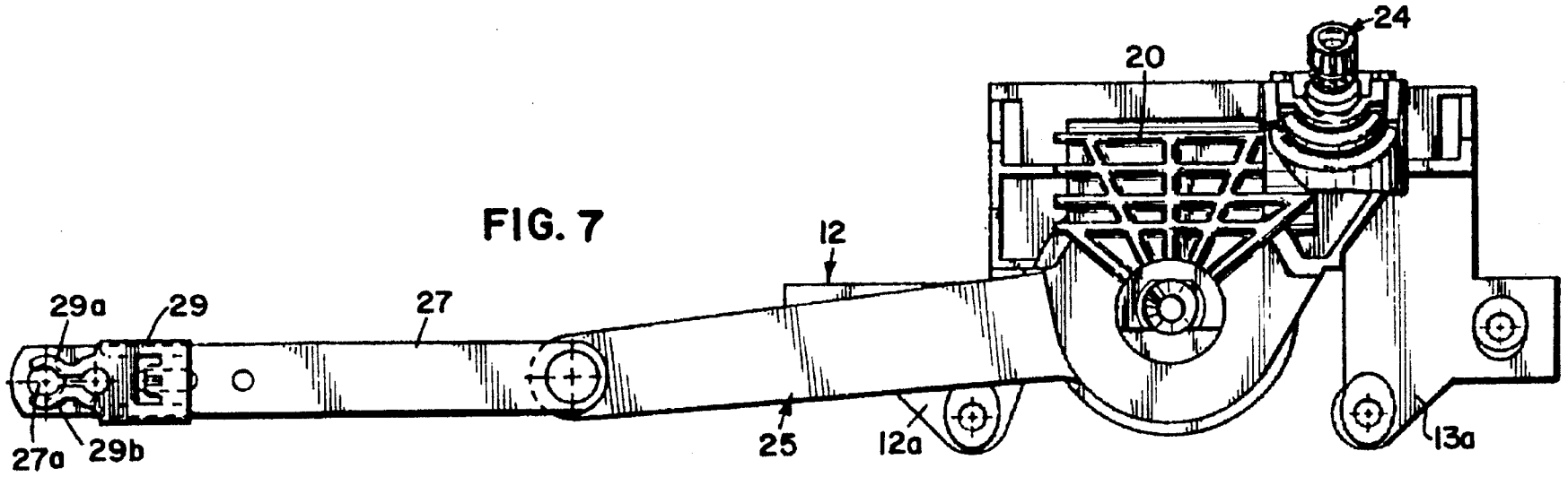
FIG. 7 is a top plan view of the operator shown in FIG. 1.

The housing 11 also includes a third gear receiving receptacle 17. The receptacle 17 is designed to support a gear which is at a 45° angle to the horizontal. The receptacle 17 includes a first semi-circular supporting surface 17*a* which also is formed at a 45° to the horizontal and the gear mount supporting surface 17*b* which also is at a 45° to the horizontal. The receptacle 17 has a backwall 17*c* and a sidewall 17*d*. The receptacle 17 also includes three supporting surface 17*e*, 17*f* and 17*g* which form half a hexagon. These surfaces are also at a 45° angle to the horizontal. Again, the receptacle 17 is open generally downward when mounted or upward as shown in FIG. 1. Four mounting pins 18 protrude downward when the operator mechanism is mounted, but are upward as viewed in FIG. 1. Two cover mounting holes 19 are formed in the housing 11. As viewed in FIG. 7, various strengthening ribs 20 are formed in the housing 11 for additional strength. It can also be appreciated that other combinations of supporting ribs may be utilized as well as filling in those ribs with additional material to gain still further strength. A bearing 21 has a first portion 21*a* which is in the general shape of a disk, having top and bottom surfaces which are generally planar. A collar 21*b* protrudes above the planar surface 21*c*. The second portion of the bearing 21 is a generally half cylindrical shape portion 21*d*. The portion 21*d* has a curved bottom surface 21*e*, sidewall 21*f* and sidewall 21*g*. The sidewall 21g has a semi-circular opening 21*h*. Preferably, the bearing is a single, one-piece unit molded from acetal or other suitable plastic or other material. The bearing 21 is designed to drop onto the hub 14*b* so that the collar 21*b* fits over the hub 14*b* and the second portion 21*d* fits into the curved portion 15*a* of the first gear receiving receptacle 15. The outer length of the portion 21*b* is such that it just fits between the sidewalls 21*f* and 21*g*.

A worm gear 22 is a worm gear having an angle of approximately 63.3°. As will discussed in more detail hereinafter, the angle of the worm gear is preferably greater than 60°. The worm gear 22 has a shaft 22*a*. The shaft 22*a* is generally circular except for a flat keyed portion 22*b*. The worm gear is sized so that the shaft 22*a* is positioned in the opening 21*h* and the worm gear has a length substantially the same as the length between the inside surfaces of sidewalls 21*f* and 21*g* so as to restrict lateral movement of the worm gear 22. In a preferred embodiment, the worm gear is a beveloid gear having a base helix angle of 63.3°.

A driven gear 23 has a bore 23*a* extending through its center. The bore 23*a* is generally circular except for a flat portion which is configure to mate with the shaft 22*a* of the worm gear 22. The driven gear 23 is assembled onto the worm gear 32 by simply placing the bore of the driven gear 23*a* on to the shaft 22*a* of the worm gear 22. Then, the worm gear 22 and driven gear 23 are dropped into the first and second gear receiving receptacles 15 and 16 respectively. As viewed in FIG. 1, they are placed into the receptacles 15 and 16 in a downward direction. The shaft 22*a* of the worm gear 22 is also support by a U-shaped section formed by the sidewalls 15*d* and 16*c*. The driven gear 23 is restricted from lateral movement by means of the sidewall 16*c* in one direction and the collar 23*b* is restricted in movement in the other direction by stop sidewall 16*d*. The gear portion of gear 23 is positioned between the sidewalls 16*c* and 16*d*. The sidewall 16*c* contacts the back portion of the gears of 23 if the gear goes too far in one direction, and the collar 23*b* is stopped by the stop sidewall 16*d* in the other direction. In a preferred embodiment the gear 23 is a beveloid gearing having 16 teeth and a cone angle of 45°, a D.P. of 28.75 and a cutter P.A. of 22.5°.

A drive gear 24 has a shaft 24*a* which extends both above and below the gear teeth 24*b*. A plastic collar 24*c* is placed around the one end of the drive shaft 24*a* and is used as a bearing support for the drive shaft 24*a*. At the other end of the drive shaft 24*a* is a splined gear 24*d* which is utilized for engagement with the handle which is used by the person operating the operator mechanism 10. However, the operation of the spline gear 24*d* in conjunction with the handle is well known in the art and will not be discussed in more detailed. The hexagonal shaped collar 24*e* is placed around the shaft 24*a* between the splined gear 24*d* and the gear teeth 24*b*. The drive gear 24 is assembled into the housing 11 by simply placing it, as viewed in FIG. 1, in a downward direction into the third gear receiving receptacle 17. The collar 24*c* rests on the semi-circular surface 17*a* and the hexagonal shaped collar 24*e* rests between the supporting surfaces 17*e*, 17*f* and 17*g*. The collar 24*e* allows for the shaft to be supported, but the hexagonal shaped supported surfaces 17*e–g* along with additional support surfaces to be discussed hereinafter, prevent rotation of the collar 24*e*. The collar 24*e* has a lip 24*f* which rests on supporting surface 17*b*. The worm gear 22 and driven gear 23 both have their axes which are generally parallel to the centerline of the window frame. The drive gear 24 has an axis which is generally transverse to the center line of the window frame. Still further, the axis of the drive gear 24 is generally 45° from the horizontal. In a preferred embodiment the drive gear 24 is a beveloid gear having 16 teeth; a cone angle of 45°; a D.P. of 28.75 and a Cutter P.A. of 22.5°.

An arm 25 has a first section 26 and a second section 27. The sections are pivotally connected by means of a rivet 28 or other suitable connection well known in the art. The arm 25 is a split arm, although it is understood that a straight arm may also be used. The second section 27 has an opening 27*a* for connection to the sash of the window. A slidable clip 29 is utilized for connecting the arm 25 to the sash. The clip has a pair of deformable ends 29*a* and 29*b* which engage a pin on the sash to operatively connect the arm 25 to the sash. The first section 26 has at its end, opposite the connection to the second section 27, an enlarged area that has a central aperture 26*a* and a plurality of gear teeth 26*b* around its outer periphery. The aperture 26*a* is configured to slidably fit over the hub 14*b* and is designed for insertion in the same direction as the other components, namely, as viewed in FIG. 1, over the top of the mounting hub 14*b*. The gear teeth 26*b* engage the worm gear 22.

The worm gear 22 and gear teeth 26*b* are designed to prevent backdrive. By having a large angle on the gears of the worm gear and sufficient friction, backdrive is prevented. Because of the need for strength, steel is a suitable material for both the worm gear 22 and gear teeth 26*b*. With these two components, applicants have found that an angle of the worm gear 22 of greater than 60° is sufficient to prevent backdrive. It is the combination of the angle of the worm gear and friction which is sufficient to prevent the back drive.

A bearing 30 has a first portion 30*a* which is in the general shape of a disk, having a bottom surface, as viewed in FIG. 1, which is in contact with the arm 25, which is planar as it is a bearing surface. The other surface 30*b* has a outer raised rim 30*c* and an inner raised rim 30*d*. A second portion of the bearing 30 is a generally half cylindrical shaped portion 30*e*. The cylindrical portion 30*e* has a curved bottom surface 31*f* and sidewalls 30*g* and 30*h*. The sidewall 30*h* has a semi-circular opening 30*i*. Preferably, the bearing 30 is a single, one-piece unit molded from acetal or other suitable plastic or other material. The bearing 30 is designed to be dropped onto the hub 14*b* so that the opening fits over the hub 14*b* and the second portion 30*e* fits over the worm gear 22. The second portions of bearings 21 and 30 form a generally cylindrical bearing which fits around the worm gear 23. Similar to the bearing 21, the outer length of portion 30*e* is such that it fits between the sidewalls 21*f* and 21*g* and it also has the same length between the inside surfaces of the sidewalls 21*f* and 21*g* so as to restrict lateral movement of the gear 22.

Figure 10:
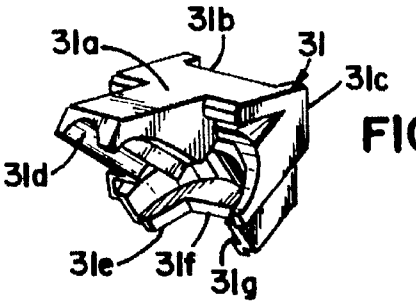
FIG. 10 is a perspective view, viewed from below of the bearing cover shown in FIG. 1.

A bearing cover 31 as shown in the exploded perspective view of FIG. 1 and also as a perspective view in FIG. 10, as viewed from below. The bearing cover 31 is designed and configured to fit over the opening of the third gear receiving receptacle 17 so as to enclose the gear teeth 24*b* as well as complete the support surfaces for the shaft 24*a* and the hex collar 24*e*. The bearing 31 has a T-shaped bottom 31*a*, the bottom has a notch 31*b* formed therein. The side 31*c* of the bearing cover which, as viewed in FIG. 10, depends downward and is behind the bottom 31*a* is configured to fit within the notched opening of the gear receptacle 17. This is the opening as viewed in FIGS. 8 and 9. The inside of the bearing cover 31 has a half-cylindrical surface 31*d* which is positioned above the semi-circular surface 17*a*. The two surfaces 17*a* and 31*d* form a cylinder in which the collar 24*c* is positioned and thereby provides a bearing support for the shaft 24*a*. The inside surface of the bearing 31 also include three sidewalls 31*e*, 31*f* and 31*g*. These three sidewalls are positioned above the sidewalls 17*e–g* and thereby a hexagonal surface is formed to provide a bearing support for the hexagonal collar 24*e* and thereby a bearing surface for the drive gear 24.

A bottom plate 32 has a first section 33 and a second section 34 operatively connected thereto. The first section 33 is generally circular and has a configuration generally shaped to be placed over and cover the gear teeth 26*b* of the first section 26. The first section 33 has an aperture 33*a* which is sized to be mounted on the mounting hub 14*b* and installed from the direction, as shown in FIG. 1, from above, the same as the other components of this mechanism. The aperture 33*a* has an lobe 33*b* which is sized to be installed over the mounting pin 14*d* to further hold the plate 32 in positioned. The second section 34 is sized and configured to be installed over the first, second and third receiving receptacles 13–15. The plate has openings 34*a* which are sized to first over the mounting pins 18. Again, the plate 32, as viewed in FIG. 1, is designed to be mounted from above and is placed down over the mounting pins 18. Finally, in the assembly of this mechanism, the mounting pins 18 protrude slightly above the openings 34*a* and are flattened and deformed to hold the plate 32 in position. The plate 32 has a downwardly depending flange 34*b* for engagement with the housing by engagement with the notch 31*b* of the bearing cover 31.

Figure 2:
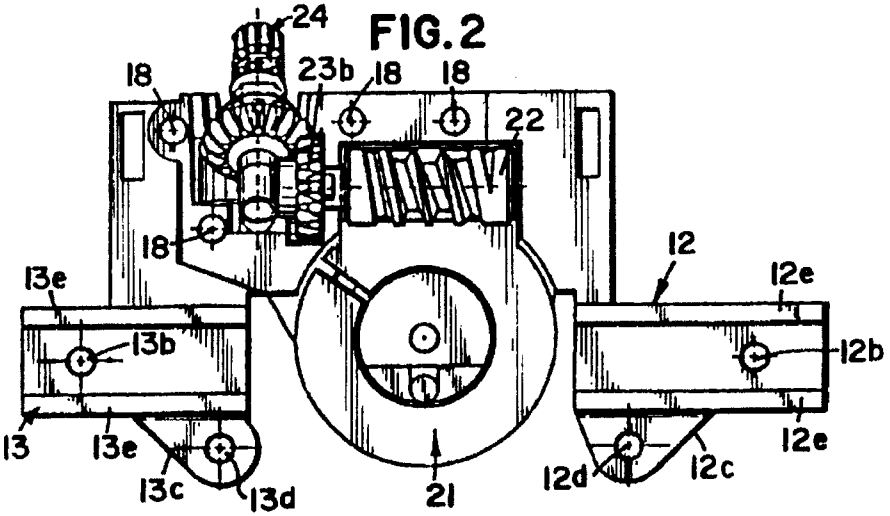
FIG. 2 is a bottom plan view of the operator shown in FIG. 1, shown during the first stages of assembly.
Figure 3:
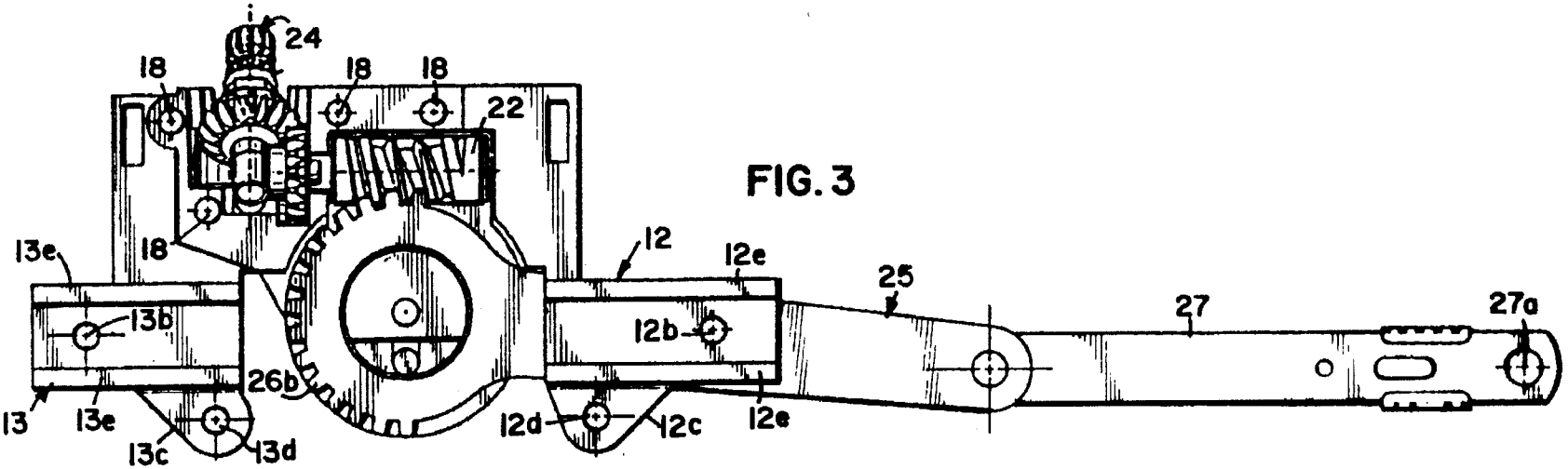
FIG. 3 is a bottom plan view of the operator shown in FIG. 2 being more fully assembled than FIG. 2.
Figure 4:
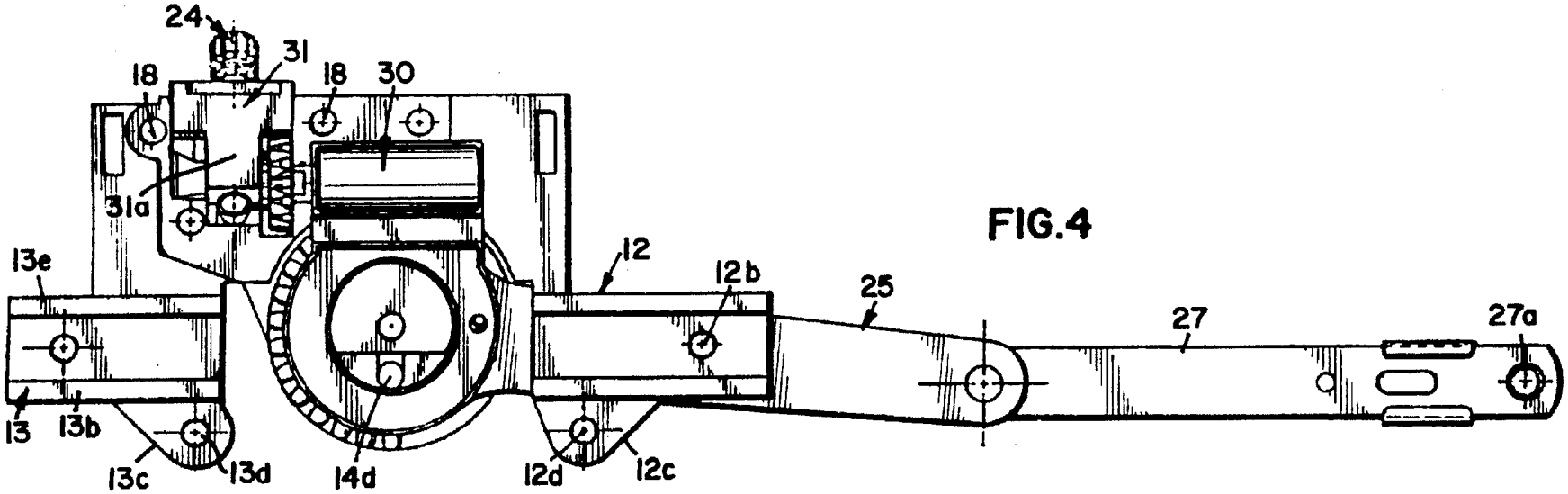
FIG. 4 is a bottom plan view of the operator shown in FIG. 2 being more fully assembled than FIG. 3.
Figure 5:
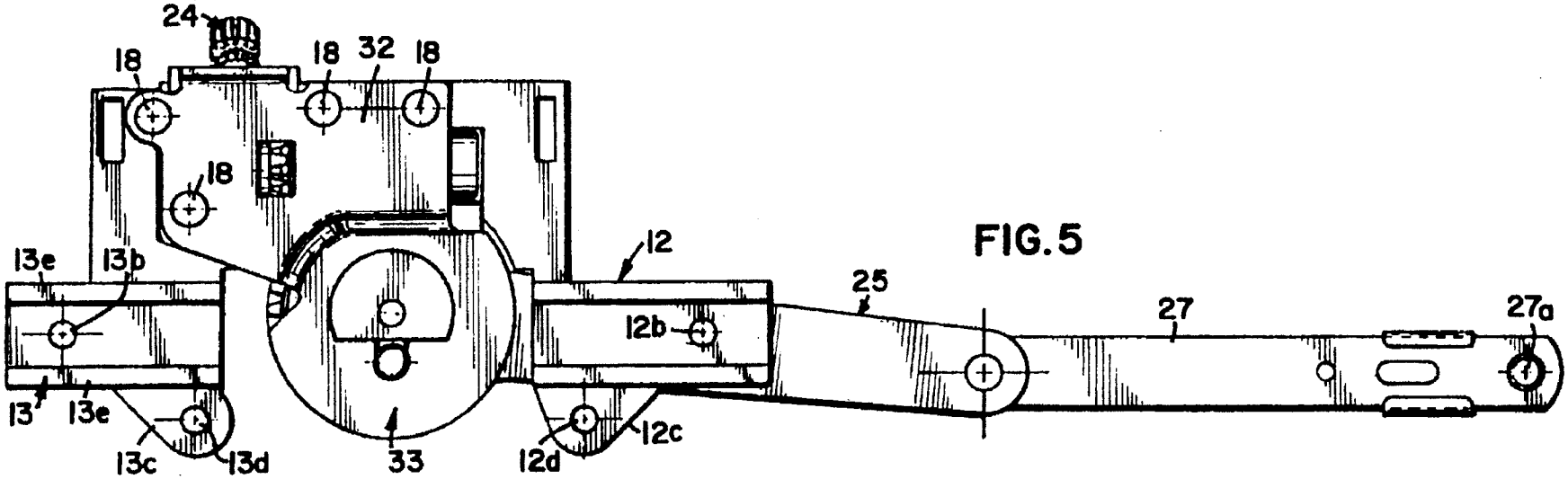
FIG. 5 is a bottom plan view of the operator shown in FIG. 2 being more fully assembled than FIG. 4, and is completed.

While the assembly of the mechanism 10 has been described in general in the preceding paragraphs, specific attention is directed to FIGS. 2 through 5 which disclose in more detail the sequence of assembly. In FIG. 2, the housing 11 is shown after the bearing 21 has been placed over the hub 14*b*. The drive gear 24 has been placed in position in the third gear receiving receptacle 17 and the worm gear 22 has been assembled to the driven gear 23 and placed into their respective gear receiving receptacles 15 and 16. The worm gear 22 is in the bearing 21, which has been placed in the gear receiving receptacle 15 first. Next, the arm 25 is placed in position by inserting the aperture 26*a* over the hub 14*b* and the gear teeth 26*b* engage the worm gear 22. This is shown in FIG. 3. Then, in FIG. 4, the bearing 30 has been placed in position over the hub 14 and the cylindrical portion of the bearing 30 has been placed over the worm gear 22. In addition, the bearing cover 31 has been placed in position over the drive gear 24, thereby completing the bearing for the drive gear. Then, in FIG. 5, the plate 32 has been attached to the housing 11 by placing the holes 34*a* over the mounting pins 18. The mounting pins 18 which protrude slightly about the plate 18 have pressure applied to them and the top portion is flattened and deformed extending out over the periphery of the holes 34*a*, thereby holding the plate firmly in position.

FIG. 11 shows the operator 10 installed in a window 100. The operator 10 is installed to the sill 101 of the window frame by screws 105 through the mounting holes 12*b* and *d* and 13*b* and *d*. A plate 110 is operatively connected to the window sash 102 by screws 106 or other appropriate means. The plate 110 has a pin 110*a* and the opening 27*a* of the arm is placed over the pin 110*a* and the clip 29 is moved in position and the clip is operatively connected to the pin 110*a* by means of the deformable pins 29*a* and *b*. A hinge (not shown) is also utilized to connect the window, such hinge being well known in the art.

Figure 6:
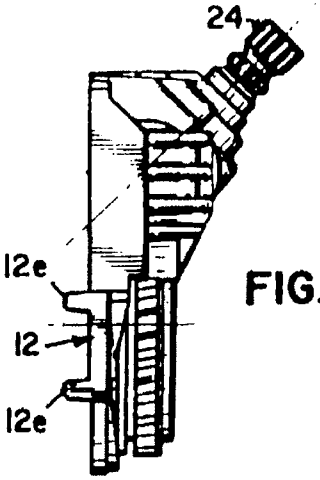
FIG. 6 is a side elevational view of the operator shown in FIG. 1.

FIGS. 11 shows the window in a closed position and in phantom line shows the window in an open position. As can be seen, the drive gear 24 is generally transverse to a center line of the window frame, and the worm gear 22 is generally parallel to the centerline of the window frame. This construction allows for the gear teeth 26*b* to be around the outer periphery of more than 180°. By doing so, this allows the arm 25 to rotate 180°. Therefore, the operator 10 can be used for either a left hand or a right hand window opening. As can be seen in the FIG. 11, the movement of the arm 25 is somewhat restricted by the housing and, as shown, would only have a rotation of 173°. However, if it was necessary to have the full 180° rotation, the housing could be slightly modified to allow for the full rotation of 180°. As seen in FIG. 6, not only is the gear 24 generally transverse to the centerline of the window frame, it also is at a 45° angle to the horizontal. This allows for a handle (not shown) to be connected at the end of the spline gear 24*d* for the handle to be as long as possible without interference on the housing. By having a longer handle, the operator is able to gain more of a mechanical advantage in rotating the drive gear 24.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

We claim:

1. An operator mechanism for mounting to a window frame, the window frame having a centerline and a window sash, the operator mechanism for moving the sash between an open position and a closed position comprising:

(a) a housing having first, second and third gear receiving receptacles and an arm receiving hub operatively connected to said housing;

(b) a worm gear positioned in said first gear receiving receptacle, said worm gear generally parallel to the centerline of the window frame;

(c) a driven gear positioned in said second gear receiving receptacle and operatively connected to said worm gear;

(d) a drive gear positioned in said third gear receiving receptacle and operatively connected to said driven gear, said drive gear generally transverse to the centerline of the window frame;

(e) a handle operatively connected to said drive gear for rotational movement of said drive gear; and (f) an arm operatively connected at its first end to said hub, said arm having gear teeth for operative engagement with said worm gear and said arm operatively connected at its second end to the sash, wherein rotational movement of said handle, through said drive gear, driven gear, worm gear and gear teeth causes movement of said arm, thereby moving the sash between an open and closed position.

2. The operator mechanism of claim 1, further comprising said worm gear is a beveloid gear having a base helix angle of greater than 60° to prevent backdrive.

3. The operator of claim 2, further comprising a first bearing positioned between said housing and said arm, said bearing having an arcuate bearing surface generally conforming to said first receptacle, thereby providing a bearing for said worm gear.

4. The operator of claim 3, wherein said arcuate bearing surface has a length substantially equal to a length of said worm gear, thereby preventing lateral movement of said worm gear.

5. The operator of claim 4, wherein said second gear receiving receptacle includes generally parallel first and second sides, said drive gear positioned between said sides, said sides limiting lateral movement of said drive gear.

6. The operator of claim 5, further comprising said drive gear having a shaft having first and second ends, said third gear receiving receptacle having a first semi-circular supporting surface and a first non-circular surface and a bearing cover having a second semi-circular supporting surface and a second non-circular surface, said first and second semi-circular supporting surface forming a second bearing surface for said first end of said shaft and said first and second non-circular surfaces positioned proximate each other.

7. The operator of claim 6, further comprising a third bearing having an inner opening in which said second end of said shaft is positioned for rotation and an outer surface configured to fit between said first and second non-circular surfaces.

8. An operator mechanism for mounting to a window frame, the window frame having a centerline and a window sash, the operator mechanism for moving the sash between an open position and a closed position, said operator mechanism designed for drop-in assembly, comprising:

(a) a housing having first, second and third gear receiving receptacles, said receptacles each having an opening in a first direction;

(b) said housing having a hub operatively connected to said housing, said hub extending in said first direction;

(c) a worm gear having a shaft;

(d) a driven gear having a bore, said bore insertable over said shaft, thereby operatively connecting said driven gear to said worm gear;

(e) said driven gear and said worm gear are placed in said first and second gear receiving receptacles by placing them in position through said openings in said first direction;

(f) an arm having first and second ends, said first end having an opening formed therein and gear teeth around its outer periphery, said arm operatively connected to said housing by placing said opening over said hub from said first direction and said gear teeth engaging said worm gear;

(g) a drive gear placed in said third gear receiving receptacle by placing it in position through said third gear receiving receptacle opening in said first direction; and (h) a plate operatively connected to said housing, said plate positioned over the second end of said arm and said gears, said plate placed in position on said housing from said first direction.

9. The operator of claim 8, further comprising a first bearing positioned between said housing and a first side of said arm, said bearing having an arcuate bearing surface generally conforming to said first receptacle, thereby providing a bearing surface for said worm gear, said first bearing also having a generally planar surface having an opening formed therein, said planar surface providing a bearing surface of said arm, said first bearing operatively connected to said housing by placing said opening over said hub in said first direction.

10. The operator of claim 9, further comprising a second bearing positioned between said housing and a second side of said arm, said bearing having an arcuate bearing surface, which in combination with said arcuate bearing surface of said first bearing forms a cylinder generally conforming to said worm gear, thereby providing a bearing surface for said worm gear, said second bearing also having a generally planar surface having an opening formed therein; said planar surface providing a bearing surface of said arm, said second bearing operatively connected to said housing by placing said opening over said hub in the first direction.

11. The operator of claim 10, further comprising said drive gear having a shaft having first and second ends, said third gear receiving receptacle having a first semi-circular supporting surface and a first non-circular surface and a bearing cover having a second semi-circular supporting surface and a second non-circular surface, said first and second semi-circular supporting surface forming a second bearing surface for first end of said shaft and said first and second non-circular surfaces positioned proximate each other when said bearing cover is placed in position on said housing in said first direction.

12. A method of assembling an operator mechanism for mounting to a window frame, the window frame having a centerline, and a window sash for moving the sash between an open position and a closed position comprising:

(a) positioning a housing having first, second and third gear receiving receptacles, each having an opening in a first direction, and an arm receiving hub extending from the housing in the first direction so that the openings and hub are positioned upward;

(b) operatively connecting a worm gear to a driven gear;

(c) placing the worm gear and driven gear down into the first and second receptacles;

(d) placing an arm, having first and second ends and having an opening formed therein and gear teeth around its outer periphery, down over the hub;

(e) placing a drive gear down into the third receptacle;

(f) placing a plate down over the housing;

(g) securing the plate to said housing, whereby the operator mechanism is assembled.

13. The method of claim 12, further comprising positioning a first bearing down over the hub prior to placing the worm gear, the first bearing having an arcuate bearing surface generally conforming to said first receptacle, thereby providing a bearing surface for said worm gear, said first bearing also having a generally planar surface having an opening formed therein, said planar surface providing a bearing surface of said arm, said first bearing operatively connected to said housing by placing said opening down over said hub.

14. The method of claim 13, further comprising positioning a second bearing down over the hub after placing the worm gear, the second bearing having an arcuate bearing surface, which is combination with said arcuate bearing surface of said first bearing forms a cylinder generally conforming to said worm gear, thereby providing a bearing surface for said worm gear, said second bearing also having a generally planar surface having an opening formed therein, said planar surface providing a bearing surface of said arm, said second bearing operatively connected to said housing by placing said opening down over said hub.

15. The method of claim 14, further comprising placing a bearing cover down over the third receptacle to form, with the third receptacle, a bearing surface for the drive gear.

* * * * *